US005550620A

United States Patent [19]

Kimura et al.

[11] Patent Number: 5,550,620

[45] Date of Patent: Aug. 27, 1996

[54] IMAGE FORMING APPARATUS WITH ATTRACTION CHARGER HAVING FIRST AND SECOND ELECTRODES

[75] Inventors: Yoichi Kimura, Kawaguchi; Isao Kumada, Yamato; Takashi Hasegawa, Ageo; Satoshi Tamura, Yokohama, all of Japan

[73] Assignee: Canon Kabushiki Kaisha, Tokyo, Japan

[21] Appl. No.: 366,500

[22] Filed: Dec. 30, 1994

[30] Foreign Application Priority Data

Jan. 11, 1994 [JP] Japan ..... 6-001315
Dec. 26, 1994 [JP] Japan ..... 6-322415

[51] Int. Cl.[6] ..... G03G 21/00

[52] U.S. Cl. ..... 355/273; 355/274; 355/308

[58] Field of Search ..... 355/271, 273, 355/272, 308, 274, 326 R

[56] References Cited

U.S. PATENT DOCUMENTS

| | | | |
|---|---|---|---|
| 5,019,871 | 5/1991 | Takeda et al. | 355/309 |
| 5,083,167 | 1/1992 | Fukushima et al. | 355/274 |
| 5,132,737 | 7/1992 | Takeda et al. | 355/271 |
| 5,172,172 | 12/1992 | Amemiya et al. | 355/271 |
| 5,239,347 | 8/1993 | Onodera et al. | 355/274 |
| 5,276,483 | 1/1994 | Hasegawa et al. | 355/208 |
| 5,335,053 | 8/1994 | Hasegawa | 355/274 |

*Primary Examiner*—Nestor R. Ramirez
*Attorney, Agent, or Firm*—Fitzpatrick, Cella, Harper & Scinto

[57] ABSTRACT

This invention relates to an image forming apparatus which has a recording material support member for supporting a recording material and moving therewith, an image forming unit for forming an image on the recording material supported by the recording material support member, and attraction charging devices for electrostatically attracting the recording material to said recording material support member. The attraction charging devices are first and second electrodes positioned across the recording material support member from each other, wherein a center of charging of the first electrode to the recording material support member is shifted from a center of charging of the second electrode, in the moving direction of said recording material support member, and there may also be an auxiliary charger for charging, prior to image formation, the recording material attracted to the recording material support member.

33 Claims, 5 Drawing Sheets

IMAGE FORMING APPARATUS WITH ATTRACTION CHARGER HAVING FIRST AND SECOND ELECTRODES

BACKGROUND OF THE INVENTION

1. Field of the Invention

The present invention relates to an image forming apparatus such as an electrophotographic or electrostatic copying apparatus or a laser beam printer, and more particularly to an image forming apparatus adapted to form an image on a recording material supported on a recording material support member.

2. Related Background Art

It is already known, in the field of image forming apparatus for forming a full-color image, to support a recording material such as paper on a recording material support member such as a dielectric sheet and to form an image on such recording material. Such image formation can be achieved by transferring an image, formed on an image bearing member such as a photosensitive member, by means of a transfer charger positioned at the back of the recording material support member.

It is also known, for electrostatically attracting the recording material to the recording material support member, to provide a corona charger and a roller electrode as a counter electrode, across said recording material support member. It is also proposed to provide a charging brush for attraction, instead of said corona charger.

In such attraction charging means, as shown in FIG. 2, the center of charging of a charging brush 105*c* coincides with that of an attraction roller 105*g* in mutually opposed manner, and is located at the center of the contact area of said charging brush 105*c* or attraction roller 105*g* with a recording material support member 105*f*. However, with such attraction means for electrostatically attracting the recording material to the recording material support member 105*f*, in which the center of charging of the charging brush 105*c* coincides with that of the attraction roller 105*g* in the moving direction of the recording material support member 105*f*, there has been encountered a drawback that the recording material cannot be stably transported by the recording material support member 105*f* due to a deficient attractive force. Such drawback becomes particularly conspicuous in case a recording material requiring a large attractive force, such as a cardboard, is transported by the recording material support member 105*f* for image formation.

SUMMARY OF THE INVENTION

In consideration of the foregoing, an object of the present invention is to provide an image forming apparatus capable of satisfactory image formation on a recording material supported and transported by a recording material support member.

Another object of the present invention is to provide an image forming apparatus provided with charging means for attraction, capable of stably attracting the recording material to the recording material support member.

Still another object of the present invention is to provide an image forming apparatus capable of suppressing an image unevenness resulting from an uneven charging on the recording material, after it is electrostatically attracted by the charging means to the recording material support member.

Still other objects of the present invention, and the features thereof, will become fully apparent from the following detailed description, which is to be taken in conjunction with the attached drawings.

DETAILED DESCRIPTION OF THE PREFERRED EMBODIMENTS

Now the present invention will be clarified in detail by embodiments thereof shown in the attached drawings.

Figure 1:
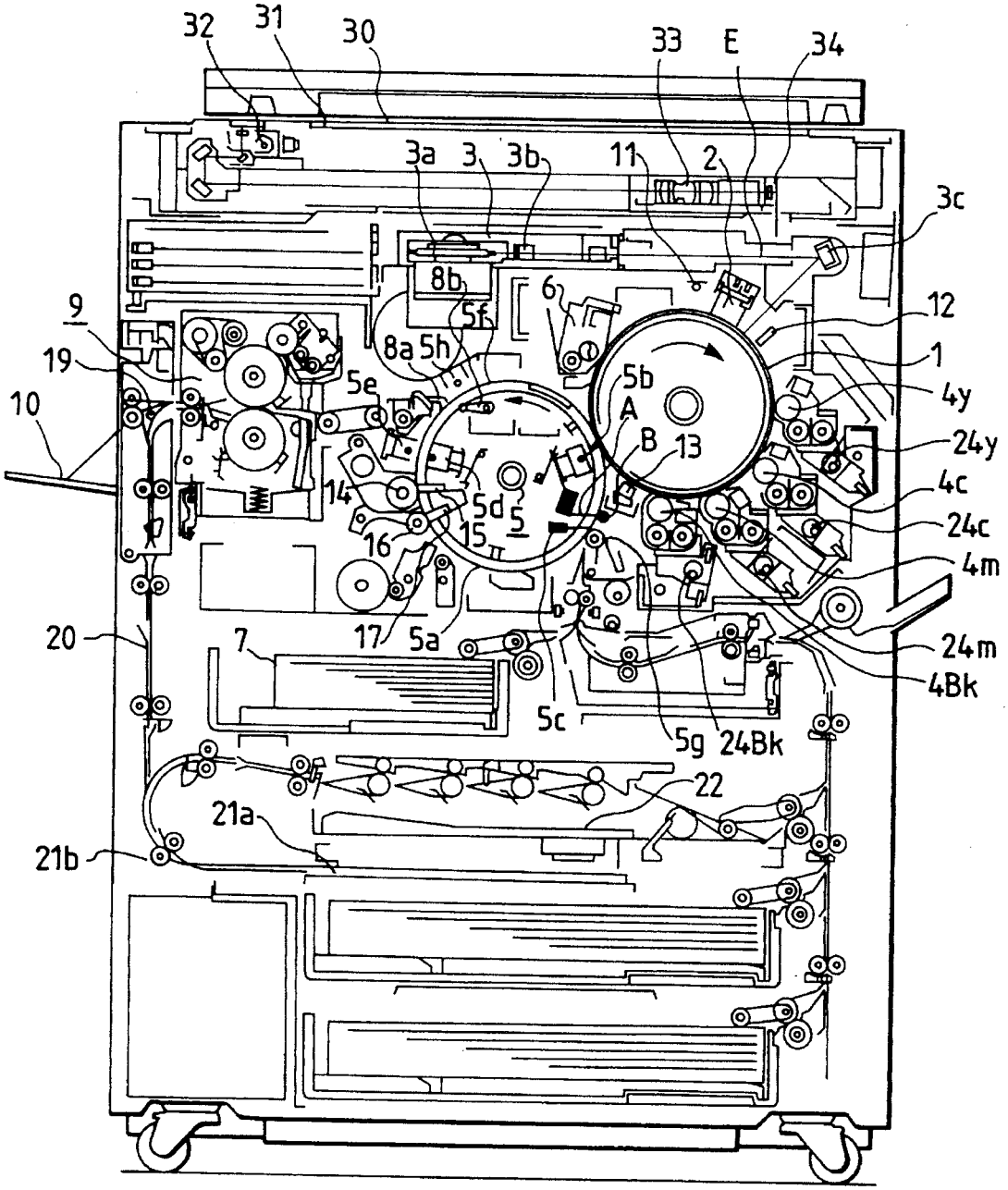
FIG. 1 is a cross-sectional view of an electrophotographic full-color printer embodying the present invention.
Figure 2:
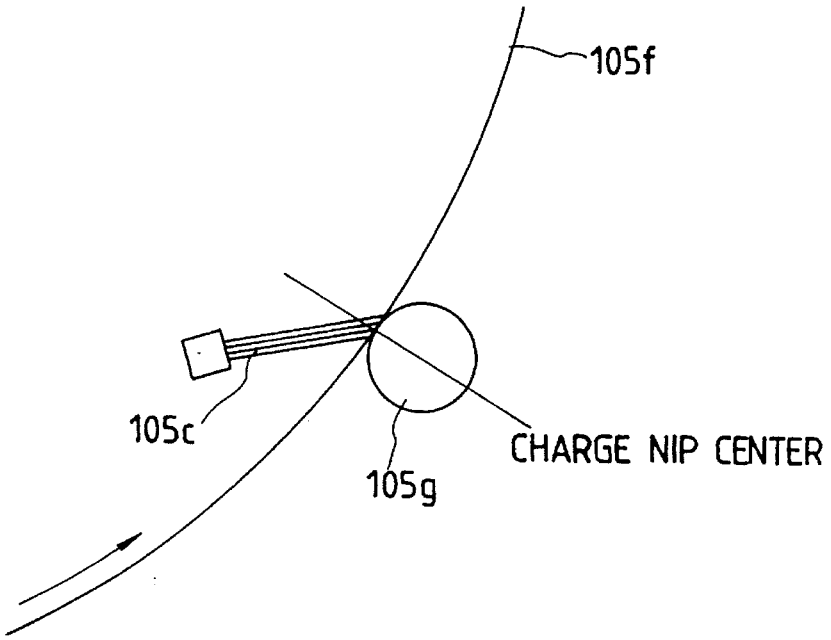
FIG. 2 is a partial view showing the arrangement of charging means for attraction.

FIG. 1 is a cross-sectional view of a color image forming apparatus, embodying the present invention and comprised of a digital color image reader unit in the upper part and a digital color image printer unit in the lower part.

In the reader unit, an original 30 is placed on an original supporting glass plate 31 and is scanned with an exposure lamp 32, and the light reflected from said original 30 is focused by a lens 33 onto a full-color sensor 34 to obtain color-separated image signals, which are supplied through an amplifying circuit (not shown), then processed by a video process unit (not shown) and sent to the printer unit. In the printer unit, a photosensitive drum 1 constituting an image bearing member is rotatably supported in a direction indicated by an arrow, and around said photosensitive drum 1 there are provided a pre-exposure lamp 11, a corona charger 2, a laser exposure optical system 3, a potential sensor 12, four developing units 4*y*, 4*c*, 4*m* and 4B*k* of different colors, an on-drum light amount detection means 13, a transfer unit 5 and a cleaning unit 6.

In the laser exposure optical system 3, the image signals from the reader unit are converted into optical signals in a laser output unit (not shown), and thus converted laser beam is reflected by a polygon mirror 3*a*, then guided by a lens 3*b* and a mirror 3*c* and projected onto the photosensitive drum 1. At the image formation in the printer unit, the photosensitive drum 1 is rotated in the direction of the arrow. It is uniformly charged by the charger 2, after charge elimination by the pre-exposure lamp 11, and is exposed to an optical image E for each separated color, thereby forming a latent image.

Subsequently a predetermined developing unit is activated to develop the latent image on the photosenstive drum 1, thereby forming thereon a toner image principally composed of a resinous material. The developing units are selectively brought close to the photosensitive drum 1, by the function of eccentric cams 24*y*, 24*c*, 24*m* and 24B*k*.

The toner image on the photosensitive drum 1 is transferred onto a recording material, supplied to a position opposed to the photosensitive drum 1, from a recording material cassette 7 through a transport system and a transfer unit 5. In the present embodiment, the transfer unit 5 is comprised of a transfer drum 5*a*, a transfer charger 5*b*, an attraction charger 5*c* and an attraction roller 5*g* for electrostatic attraction of the recording material, an inner charger 5*d* and an outer charger 5*e*, and a recording material support sheet 5*f* of a dielectric material is cylindrically and integrally positioned on the peripheral apertures of the rotatably supported transfer drum 5*a*. Said receiving material support sheet 5*f* is comprised of a dielectric sheet for example a polycarbonate sheet.

Along with the rotation of the transfer drum 5*a*, or the drum-shaped transfer unit, the toner image on the photosensitive drum 1 is transferred, by the function of the transfer charger 5*b*, onto the recording material supported on the recording material support sheet 5*f*.

In this manner the color images of a desired number are transferred onto the recording material support sheet 5*f*, thereby forming a full-color image. In the full-color image formation, after the transfers of four toner images of yellow, cyan, magenta and black colors, the recording material is separated from the transfer drum 5*a* by the function of a separating finger 8*a*, a separating roller 8*b* and a separating charger 5*h*, then is subjected to fusion mixing of four toners in the heat roller fixing unit 9 and is discharged to a tray 10.

On the other hand, the photosensitive drum 1 is subjected to the removal of the remaining toner by the cleaning unit 6 is used again in the image forming process.

In case of forming images on both sides of the recording material, a transport path switching guide 19 is activated after the recording material is discharged from the fixing unit 9, to guide said recording material into an inverting path 21*a* through a vertical path 20. Then an inverting roller 21*b* is reversed to transport the recording material in a direction opposite to that in the entry, from the trailing end at said entry, and to store it in an intermediate tray 22. Thereafter an image is formed on the other side by the image forming process explained above.

For avoiding the deposition of scattered powder onto the recording material support sheet 5*f* of the transfer drum 5*a* and of oil on the recording material, a cleaning operation is conducted by a fur brush 14 and a back-up brush 15 opposed thereto across the recording material support sheet 5*f* and by an oil-removing roller 16 and a back-up brush 17 opposed thereto across said sheet 5*f*. Such cleaning operation is conducted before or after the image formation and at the occasion of sheet jamming.

Figure 3A:
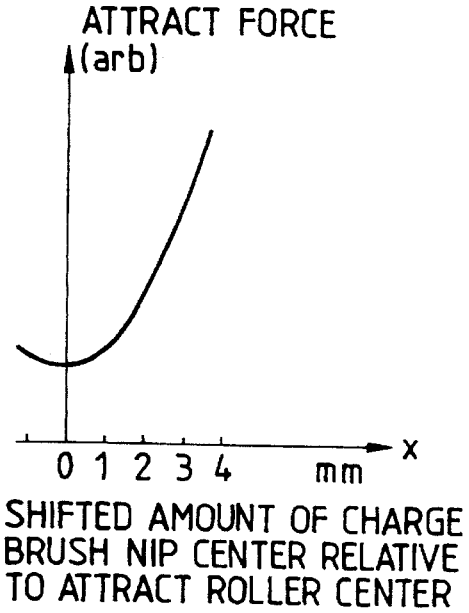
FIG. 3A is a chart showing the relationship between the shift amount x of the charging position and the electrostatic attractive force.

FIG. 3A shows the attractive force of the recording material support sheet 5*f* to the recording material, as a function of the shift amount x of the center of a nip width y of the charging brush 5*c* with respect to the center of the contact area of the attraction roller 5*g*. As shown in FIG. 3A, the attractive force is not maximum when the shift amount x is 0, but becomes maximum at a non-zero value of the shift amount x. This phenomenon is presumably because the recording material, after being charged by the attraction roller 5*g* while being attracted by the recording material support member 5*f*, passes the center of charging of the charging brush 5*c*, which is positioned at the downstream side with respect to the center of charging of said attraction roller 5*g*, in the moving direction of the recording material support member 5*f*. Consequently, a non-zero value of the shift amount x is effective for the stable transport of the recording material or for the transport of a recording material requiring a large attractive force, such as a cardboard.

Figure 3B:
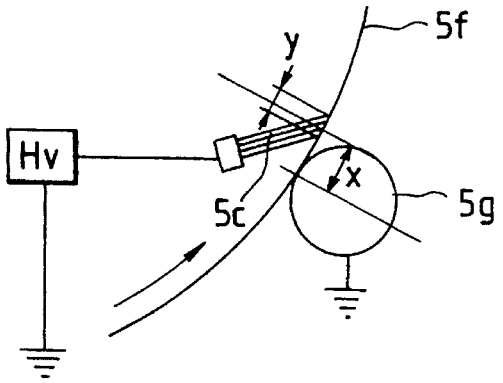
FIG. 3B is a view of the charging means for attraction of the present invention.

FIG. 3B shows the charging brush 5*c* and the attraction roller 5*g* constituting the attraction charging means in the present embodiment.

As shown in FIG. 3B, the center of charging of the charging brush 5*c* to the recording material support member 5*f* (i.e. the center of the nip width y of the charging brush 5*c* in the moving direction of the recording material support member 5*f* ) is shifted by a distance x, toward the downstream side of the moving direction of the recording material support member 5*f* , from the center of charging of the attraction roller 5*g* (i.e. the center of contact portion thereof with the recording material support member 5*f* ). In the present embodiment the nip width y of the charging brush is selected as 2 mm, and the shift amount x is selected as 3.5 mm. In the attraction charging means of the present embodiment, said shift amount x preferably does not exceed 5 mm.

In this manner the present embodiment enables to realize a sufficient attractive force between the recording material and the recording material support member 5*f* by shifting the center of charging of the charging brush 5*f* relative to the center of charging of the attraction roller 5*g* in the moving direction of the recording material support member 5*f*, thereby achieving stable transport of the recording material by the recording material support member 5*f*.

Figure 4:
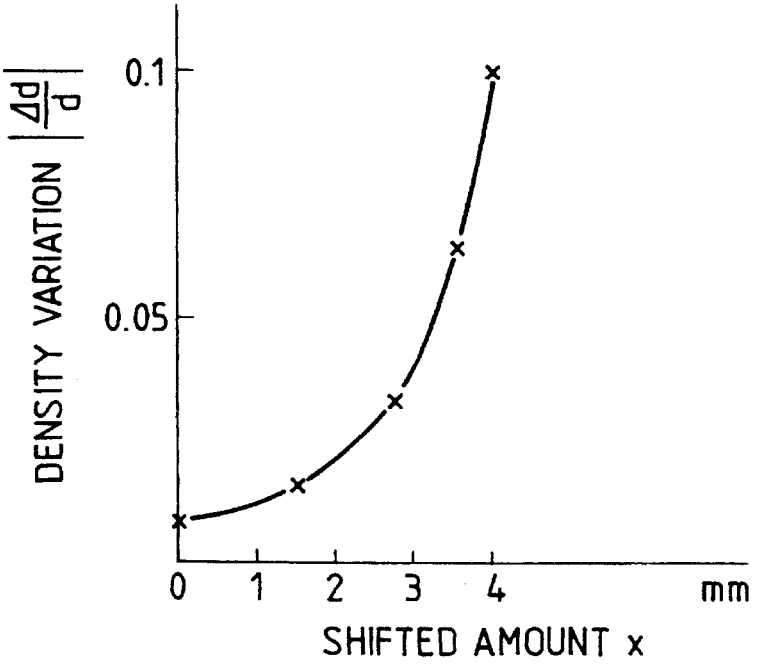
FIGS. 4 and 5 are charts showing the relationship between the shift amount x of the charging position and the density variation.

However, in the use of a pair of attraction charging means of which the centers of charging are mutually shifted as explained above, the density variation (density difference from the normal density/normal density) may become vary large on the image if the shift amount x is made large, as shown in FIG. 4. This phenomenon is caused by the uneven electric field at the image transfer position, as the mutually separate centers of charging of the attraction charger 5*c* and of the back-up roller 5*g* result in uneven charge deposition on the recording material. This phenomenon becomes particularly conspicuous under a condition of low humidity where the recording material, particularly paper, becomes electrically highly resistant, and, in such low humidity condition, it has been difficult to simultaneously achieve the satisfactory image quality and the sufficient support for the recording material requiring a large attractive force, such as cardboard.

Figure 6A:
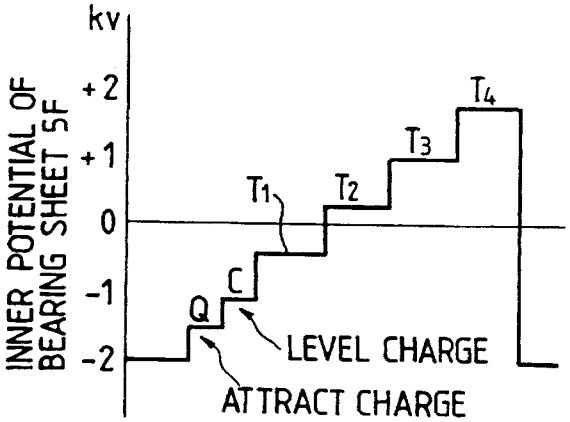
FIGS. 6A to 6F are schematic views in which the level charging brush A is connected to a voltage source, a varystor or ground, and respectively corresponding charts showing potential of the support sheet.
Figure 6B:
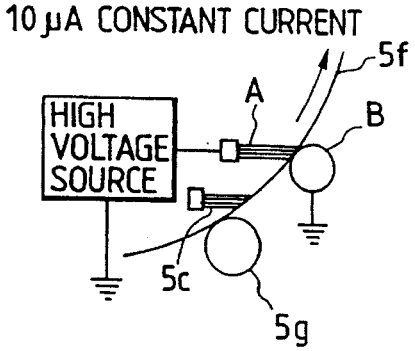

For this reason, the image forming apparatus of the present embodiment is further provided, as shown in FIGS. 1 and 6B, with auxiliary charging means consisting of a charging brush A and an opposed levelling roller B, both of which are electroconductive. As the recording material enters the transfer drum 5*a*, the attraction charger 5*c* and the attraction roller 5*g*, which have been separated from the support sheet 5*f*, are brought into contact therewith, and said attraction charger 5*c* is controlled with a constant current of +15 μA. Thus charge is injected to the recording material from the grounded attraction roller.

Prior to the attraction, the recording material support sheet 5*f* is given negative charge and positive charge, respectively on the internal and external surfaces thereof, by the inner charger 5*d* and the outer charger 5*e*.

Figure 5:
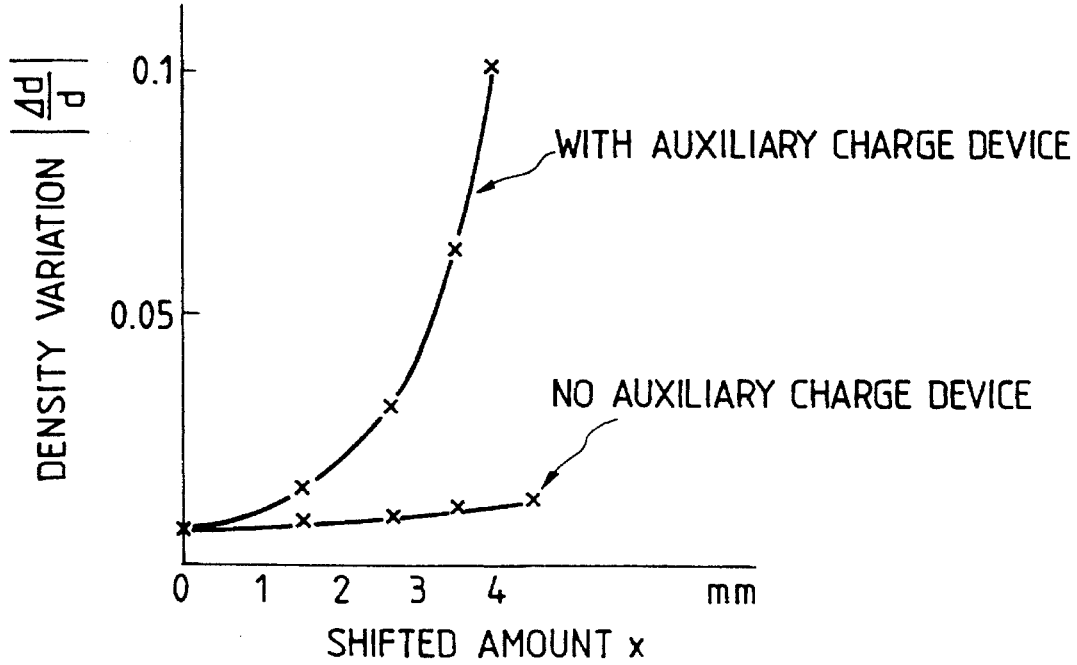

The charging brush A and the levelling roller B, which have been separated from the support sheet 5*f* prior to attraction, are brought into contact with said support sheet 5*f* almost simultaneously with the attraction charger 5*c* and the attraction roller 5*g*, and the charging brush A is controlled with a constant current of +10 μA while charge is uniformly injected to the recording material from the grounded levelling roller B. The attraction charger 5*c*, the attraction roller 5g, the charging brush A and the levelling roller B are separated immediately after the passing of the recording material. The center of charging of the charging brush A coincides with the center of the levelling roller B. FIG. 5 shows the density variation as a function of the shift amount x of the attraction charger, in case the auxiliary charging means is provided. As shown in Fig. 5, the density variation can be prevented by the presence of the auxiliary charger, even when the shift amount x is selected larger, between the centers of charging of the attraction brush 5c and the attraction roller 5g. FIG. 6A shows the variation in potential, on a face of the recording material support sheet, opposite to the face supporting the recording material, in the present embodiment. The internal surface of the support sheet 5f is charged, prior to the attraction, to −2 kV by the inner charger 5d, then shifted to ca. −1.5 kV immediately after the attraction (Q in FIG. 6A) and to −1 kV immediately after the charge levelling (C in FIG. 6A). $T_1$, $T_2$, $T_3$ and $T_4$ respectively represent the potentials immediately after the image transfers of 1st, 2nd, 3rd and 4th colors. In this manner the potential on the internal surface of the support sheet 5f increases toward the positive side, with the increase of number of image transfers. After the transfers of four color images and prior to the next image transfer, the internal surface of the support sheet 5f is charged again to −2 kV by the inner charger 5d.

Figure 6C:
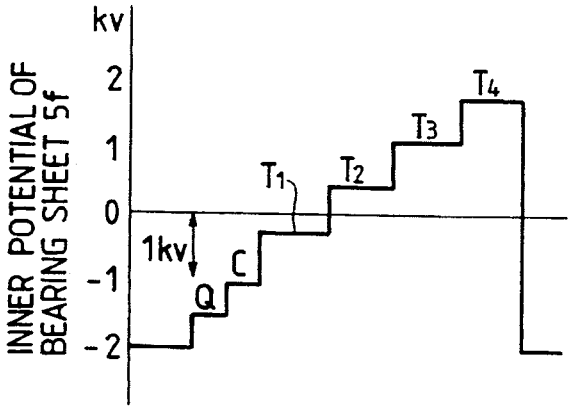
Figure 6D:
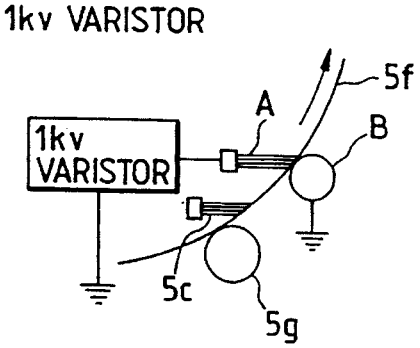

FIG. 6D shows another embodiment of the charging brush A in the auxiliary charging means, wherein said charging brush A is connected to a varistor, constituting a fixed voltage source of 1 kV, instead of the high-voltage source.

The recording material support sheet, composed of a strongly dielectric material such as polycarbonate, is charged in advance to ca. −2 kV and ca. 2 kV respectively on the internal and external surfaces by the inner charger 5d and the outer charger 5e, so that the charge injection to said support sheet 5f can be made from the brush A even without the high-voltage source. FIG. 6C shows the potential change of the support sheet 5f in case the charging brush A is grounded across the varistor as shown in FIG. 6D. The arrangement in FIG. 6D can achieve a lower cost in comparison with the case of FIG. 6B, because of the absence of the high-voltage source. In FIG. 6C, Q, C, $T_1$, $T_2$, $T_3$ and $T_4$ respectively correspond to those in FIG. 6A. The charging brush A may also be grounded across a resistor, instead of the varistor.

Figure 6E:
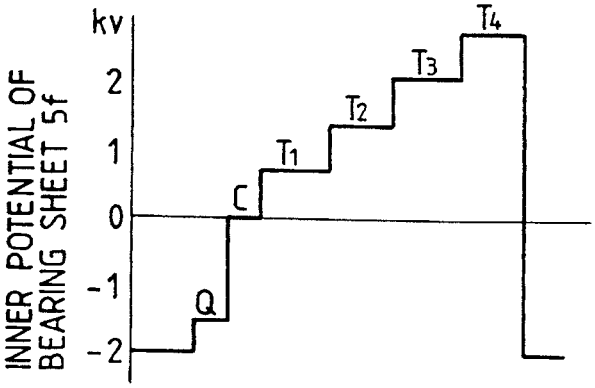
Figure 6F:
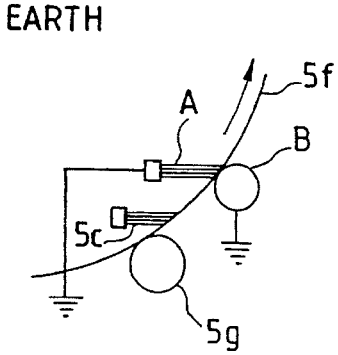

FIG. 6F shows another embodiment in which the charging brush A is directly grounded. FIG. 6E shows the potential variation of the support sheet 5f in case of FIG. 6F, wherein Q, C, $T_1$, $T_2$, $T_3$ and $T_4$ respectively correspond to those in FIG. 6A.

Figure 7:
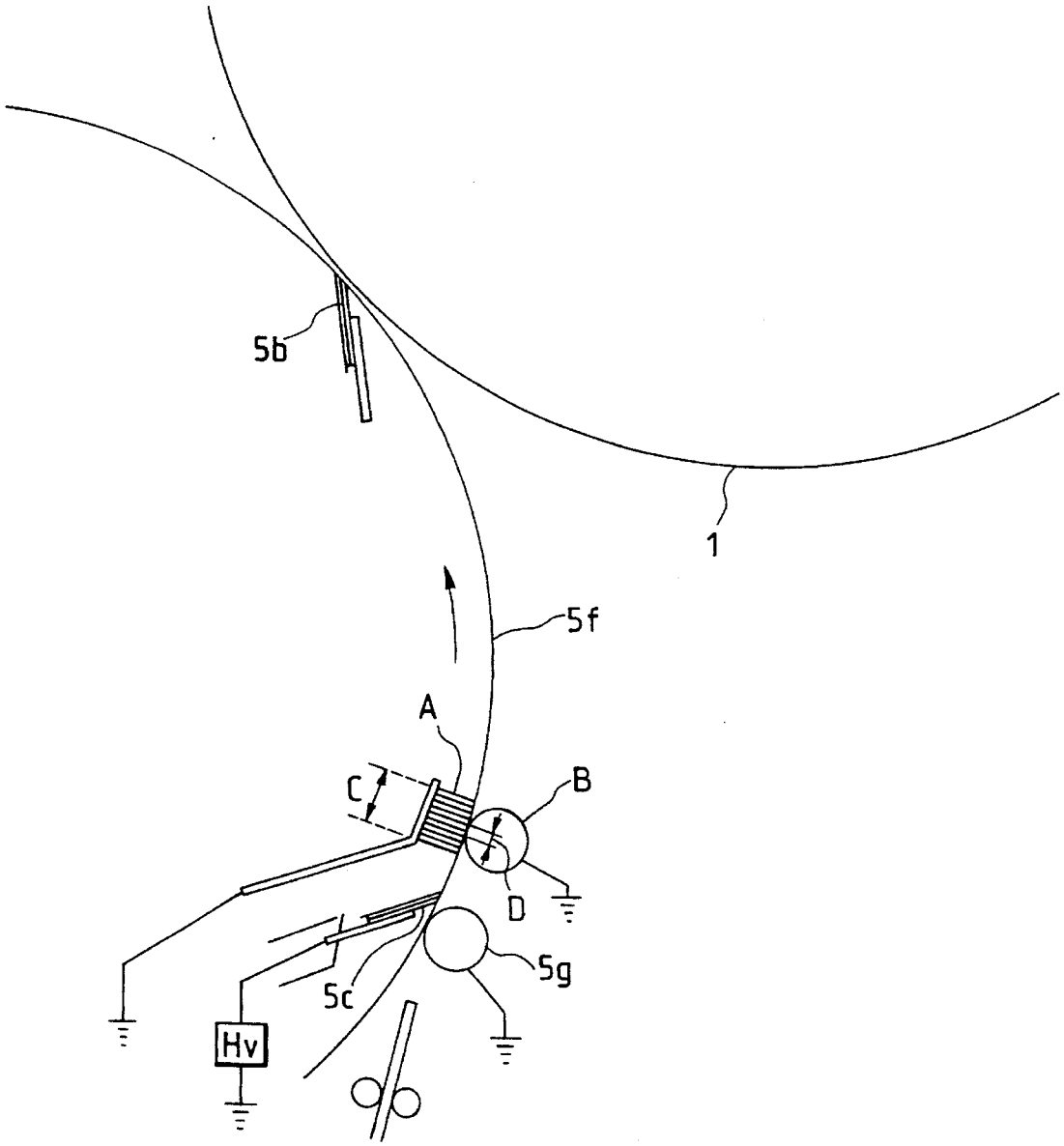
FIG. 7 is a cross-sectional view showing the level charging brush A and the levelling roller.

On the other hand, in case the auxiliary charging means is composed of a charging brush A and an opposed metal roller B as shown in FIG. 7, it is already experimentally known that the above-mentioned charge levelling effect can be exhibited if the nip width C between the brush A and the support sheet 5f overlaps, even partially, with the nip width D of the support sheet 5f, the recording material and the metal roller B. Since the support sheet 5f and the metal roller B are basically in line contact, the latitude in the position of the entire auxiliary charging means can be expanded by selecting the nip width C larger than the nip width D.

As the auxiliary charging means and the attraction charging means are brought into contact with and are separated from the support sheet 5f almost at the same time, a single driving source may be employed if the attraction brush 5C and the levelling brush A are supported by a same holder. Similarly the attraction roller 5g and the levelling roller B may be driven integrally.

Also the auxiliary charging means may be composed, instead of the charging brush A and the levelling roller B explained above, of a corona charger connected to a high-voltage source and a grounded roller or brush; a brush connected to a high-voltage source and a grounded brush; a brush grounded across a varistor and a grounded brush; or grounded brushes. Also in any of the combinations of two counter electrodes constituting the auxiliary charging means across the support sheet 5f, either electrode may be positioned inside said support sheet 5f.

The image forming apparatus of the above-explained embodiment can achieve stable electrostatic attraction to the recording material support member 5f, even in a cardboard up to ca. 160 g/cm$^2$, and satisfactory image formation without density variation even under a low humidity condition.

What is claimed is:

1. An image forming apparatus, comprising:

a recording material support member for supporting a recording material and moving therewith;

image forming means for forming an image on the recording material supported by said recording material support member; and attraction charging means for electrostatically attracting said recording material to said recording material support member, said attraction charging means including first and second electrodes positioned across said recording material support member, a center of charging of said first electrode to said recording material support member being shifted from a center of charging of said second electrode, in the moving direction of said recording material support member.

2. An apparatus according to claim 1, wherein said recording material is attracted to said recording material support member by passing the gap between said first and second electrodes.

3. An apparatus according to claim 2, wherein said second electrode is so provided as to contact said recording material, on a face of said recording material support member bearing the recording material, and said first electrode is provided at the downstream side, with respect to said second electrode, in the moving direction of said recording material support member.

4. An apparatus according to claim 3, wherein said second electrode is shaped as a roller.

5. An apparatus according to claim 3 or 4, wherein said first electrode is connected to a power source while said second electrode is electrically grounded.

6. An apparatus according to claim 1, wherein images of plural colors are superimposedly formed by said image forming means on the recording material supported by said recording material support member.

7. An apparatus according to claim 1 or 6, wherein said image forming means includes an image bearing member for bearing an image, and transfer charging means for transferring the image of said image bearing member to the recording material supported by said recording material support member.

8. An image forming apparatus according to claim 1, wherein a distance between the center of charging of said first electrode and the center of charging of said second electrode measured in the moving direction of said recording material support member is approximately 5 mm.

9. An image forming apparatus, comprising:

a recording material support member for supporting a recording material and moving therewith;

attraction charging means for electrostatistically attracting the recording material to said recording material support member, said attraction charging means including a first electrode and second electrode which are positioned across said recording material support member, a center of charging said first electrode to said recording material support member being offset from a center of charging of said second electrode, in the moving direction of said recording material support member;

image forming means for forming an image on the recording material supported by said recording material support member; and auxiliary charging means for charging, prior to the image formation by said image forming means, the recording material attracted to said recording material support means by said attraction charging means.

10. An apparatus according to claim 8, wherein said auxiliary charging means includes third and fourth electrodes provided across said recording material support member.

11. An apparatus according to claim 10, wherein the center of charging of said third electrode to said recording material support member overlaps with the center of charging of said fourth electrode.

12. An apparatus according to claim 10, wherein said fourth electrode is so provided as to contact the recording material, on a face of said recording material support member supporting said recording material.

13. An apparatus according to claim 12, wherein said third electrode is connected to a power source while said fourth electrode is electrically grounded.

14. An apparatus according to claim 12, wherein said third electrode is in contact with said recording material support member.

15. An apparatus according to claim 14, wherein said third electrode is grounded across a voltage-generating element which generates a voltage by a current flow therethrough, while said fourth electrode is electrically grounded.

16. An apparatus according to claim 15, wherein said third electrode is shaped as a brush, while said fourth electrode is shaped as a roller.

17. An apparatus according to claim 14, wherein said third and fourth electrodes are electrically grounded.

18. An apparatus according to claim 12, wherein said second electrode is so provided as to contact the recording material on a face of said recording material support member, supporting said recording material, and said second and fourth electrodes are supported by a same support member and are rendered movable between a contact position in contact with the recording material and a separate position separate from said recording material.

19. An apparatus according to claim 8, wherein images of plural colors are superimposedly formed said image forming means on the recording material supported by said recording material support member.

20. An apparatus according to claim 8 or 19, wherein said image forming means includes an image bearing member for bearing an image, and transfer charging means for transferring the image of said image bearing member to the recording material supported by said recording material support member.

21. An image forming apparatus according to claim 9, wherein a distance between the center of charging of said first electrode and the center of charging of said second electrode measured in the moving direction of said recording material support member is approximately 5 mm.

22. An image forming apparatus according to claim 9, wherein said auxiliary charge means is located downstream of a position where said attraction charging means performs the charging and upstream of a position where said image forming means performs the image formation, in the moving direction of said recording material support member.

23. An image forming apparatus, comprising:

a recording material support member for supporting a recording material thereon and moving with it;

attraction charging means for electrostatistically attracting the recording material to said recording material support member at an attracting position;

image forming means for forming an image on the recording material supported by said recording material support member at an image forming position; and auxiliary charging means for charging, prior to the image formation by said image forming means, the recording material attracted to said recording material support means by said attraction charging means, wherein said auxiliary charging means is disposed downstream of the attracting position and upstream of the image forming position, in the moving direction of said recording material supporting member.

24. An image forming apparatus according to claim 23, wherein said auxiliary charging means includes a first electrode and second electrode which are provided across said recording material support member.

25. An image forming apparatus according to claim 24, wherein the center of charging of said first electrode to said recording material support member overlaps with the center of charging of said second electrode.

26. An image forming apparatus according to claim 24, wherein said second electrode is in contact with the recording material on the face of said recording material support member supporting said recording material.

27. An image forming apparatus according to claim 26, wherein said first electrode is connected to a power source while said second electrode is electrically grounded.

28. An image forming apparatus according to claim 26, wherein said first electrode is in contact with said recording material support member.

29. An image forming apparatus according to claim 28, wherein said first electrode is grounded across a voltage-generating element generating a voltage by a current flow therethrough, while said second electrode is electrically grounded.

30. An image forming apparatus according to claim 29, wherein said first electrode is shaped as a brush, while said second electrode is shaped as a roller.

31. An image forming apparatus according to claim 28, wherein said first and second electrodes are electrically grounded.

32. An image forming apparatus according to claim 23, wherein images of plural colors are superimposedly formed by said image forming means on the recording material supported by said recording material support member.

33. An image forming apparatus according to claim 23 or 32, wherein said image forming means includes an image bearing member for bearing an image, and transfer charging means for transferring the image on said image bearing member to the recording material supported by said recording material support member.

* * * * *

UNITED STATES PATENT AND TRADEMARK OFFICE

CERTIFICATE OF CORRECTION

PATENT NO. : 5,550,620
DATED : August 27, 1996
INVENTOR(S) : YOICHI KIMURA, ET AL.

It is certified that error appears in the above-indentified patent and that said Letters Patent is hereby corrected as shown below:

Column 2,
line 20, "varystor" should read --varistor--.
Column 6,
line 49, "claim 3" should read --claims--.
Column 7,
line 59, "claim 8" should read --claims 8--.
Column 8,
line 60, "claim 23" should read --claims 23--.

Signed and Sealed this

Fourth Day of March, 1997

Bruce Lehman

*Attest:*

BRUCE LEHMAN

*Attesting Officer*

*Commissioner of Patents and Trademarks*